US012534265B2

(12) United States Patent
Minsky

(10) Patent No.: US 12,534,265 B2
(45) Date of Patent: Jan. 27, 2026

(54) SHIPPING AND DISPLAY CONTAINER

(71) Applicant: WestRock Shared Services, LLC, Atlanta, GA (US)

(72) Inventor: Craig F. Minsky, Germantown, WI (US)

(73) Assignee: WestRock Shared Services, LLC, Atlanta, GA (US)

( * ) Notice: Subject to any disclaimer, the term of this patent is extended or adjusted under 35 U.S.C. 154(b) by 727 days.

(21) Appl. No.: 17/898,367

(22) Filed: Aug. 29, 2022

(65) Prior Publication Data

US 2023/0061172 A1 Mar. 2, 2023

Related U.S. Application Data

(60) Provisional application No. 63/238,139, filed on Aug. 28, 2021.

(51) Int. Cl.
*B65D 5/54* (2006.01)
*B65D 5/02* (2006.01)

(52) U.S. Cl.
CPC ..... *B65D 5/542* (2013.01); *B65D 5/0227* (2013.01); *B65D 5/0236* (2013.01)

(58) Field of Classification Search
CPC .... B65D 5/542; B65D 5/0227; B65D 5/0236; B65D 5/443; B65D 5/16; B65D 5/001; B65D 5/0281; B65D 5/5405; B65D 2571/0066; B65D 5/42; B65D 5/2076; B65D 5/701; B65D 5/705; B31B 50/624
USPC ..... 229/242, 103, 240, 122.34; 206/736
See application file for complete search history.

(56) References Cited

U.S. PATENT DOCUMENTS

| | | | | |
|---|---|---|---|---|
| 4,588,084 | A * | 5/1986 | Holley, Jr. | B65D 71/36 206/427 |
| 5,657,872 | A | 8/1997 | Leftwich et al. | |
| 5,950,914 | A | 9/1999 | Dunton et al. | |
| 6,371,365 | B1 | 4/2002 | Doucette et al. | |
| 6,899,221 | B2 * | 5/2005 | Skolik | B65D 71/36 206/427 |
| 7,080,736 | B2 | 7/2006 | Jackson et al. | |

(Continued)

FOREIGN PATENT DOCUMENTS

| | | |
|---|---|---|
| JP | 6531037 B2 | 6/2019 |
| WO | 2016129676 A1 | 8/2016 |

*Primary Examiner* — Christopher R Demeree
(74) *Attorney, Agent, or Firm* — Neil G. Cohen; Rohini K. Garg

(57) ABSTRACT

Techniques and/or systems are disclosed for a container including a plurality of panels and a plurality of flaps integrally formed in a blank. The plurality of panels includes a front panel, a top panel adjacent the front panel, a back panel adjacent the top panel, a bottom panel adjacent the back panel, and a support panel adjacent the bottom panel, wherein adjacent panels are connected with one another. The plurality of flaps are configured to cooperate with each other to enclose the container at its ends. A first line of weakness is formed in the front and top panels and defines a first severable portion of the container. A second line of weakness is formed in the support panel and defines a second severable portion of the container, the support panel being fixedly attached to the front panel such that the first and second severable portions are generally aligned.

20 Claims, 6 Drawing Sheets

(56) References Cited

U.S. PATENT DOCUMENTS

| | | | | |
|---|---|---|---|---|
| 7,757,933 | B2 * | 7/2010 | Dunn | B65D 71/36 206/427 |
| 8,740,054 | B2 * | 6/2014 | Pinkstone | B65D 5/54 229/242 |
| 8,985,336 | B1 | 3/2015 | Yost et al. | |
| 9,169,039 | B2 | 10/2015 | Freeman | |
| 10,414,537 | B2 | 9/2019 | Imai et al. | |
| 10,549,875 | B2 * | 2/2020 | Spivey, Sr. | B65D 5/46072 |
| 11,396,398 | B2 * | 7/2022 | Gressel | B65D 5/4608 |
| 12,049,346 | B1 * | 7/2024 | Bley | B65D 5/542 |
| 2003/0146130 | A1 | 8/2003 | Kanter et al. | |
| 2005/0263434 | A1 | 12/2005 | Tibbels | |
| 2006/0124507 | A1 | 6/2006 | Kanter et al. | |
| 2015/0375892 | A1 | 12/2015 | Hamilius et al. | |
| 2019/0016499 | A1 | 1/2019 | Dey et al. | |

* cited by examiner

SHIPPING AND DISPLAY CONTAINER

FIELD

The present disclosure relates generally to displayable shipping containers that may be used for shipping products and then converted to display and provide access to the products for individual sale. In particular, the present application relates to displayable shipping containers formed from a single blank and including reinforcement features.

BACKGROUND

Dual-purpose containers have been developed that can be used for both shipping and displaying goods. Generally, the containers start as flat sheets of corrugated paperboard, typically referred to as blanks. The blanks can then be assembled into containers for shipping goods, which can also be converted into a display for the goods contained therein. This practice reduces costs to stores because merchandise does not need unloaded from the shipping boxes and arranged on the shelves.

In shipping and displaying products, particularly in a retail setting, it is desirable to have a container, which is easy to pack, sturdy and fully enclosed for protection of contents during storage and shipping, while also being suitable for store display. A container can be provided that is convertible from a shipping configuration to a display configuration, which permits the converted container to be placed directly upon a shelf, or floor display, without having to remove the individual product items from the container. Typically, this is accomplished by providing the container with removable portions of the container that create apertures through which customers may access the products within the converted container.

Some displayable shipping containers are comprised of multiple components requiring several steps to assemble the container and often requiring multiple machines, some of which are specialized, to assist in assembly of the container, such as by applying adhesive.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

In one implementation, there is provided a container comprising a plurality of panels and a plurality of flaps integrally formed in a blank. The plurality of panels includes a front panel, a top panel adjacent the front panel, a back panel adjacent the top panel, a bottom panel adjacent the back panel, and a support panel adjacent the back panel, wherein adjacent panels are connected with one another. The plurality of flaps are configured to cooperate with each other to enclose the container at ends of the container. A first line of weakness is formed in the front panel and top panel, wherein the first line of weakness defines a first severable portion of the container that is configured to be removable. A second line of weakness formed in the support panel, wherein the second line of weakness defines a second severable portion of the container that is configured to be removable. The support panel is fixedly attached to an inner surface of the front panel such that the first severable portion and the second severable portion are generally aligned To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

BRIEF DESCRIPTION OF THE DRAWINGS

What is disclosed herein may take physical form in certain parts and arrangement of parts, and will be described in detail in this specification and illustrated in the accompanying drawings which form a part hereof and wherein.

DETAILED DESCRIPTION

Figure 1:
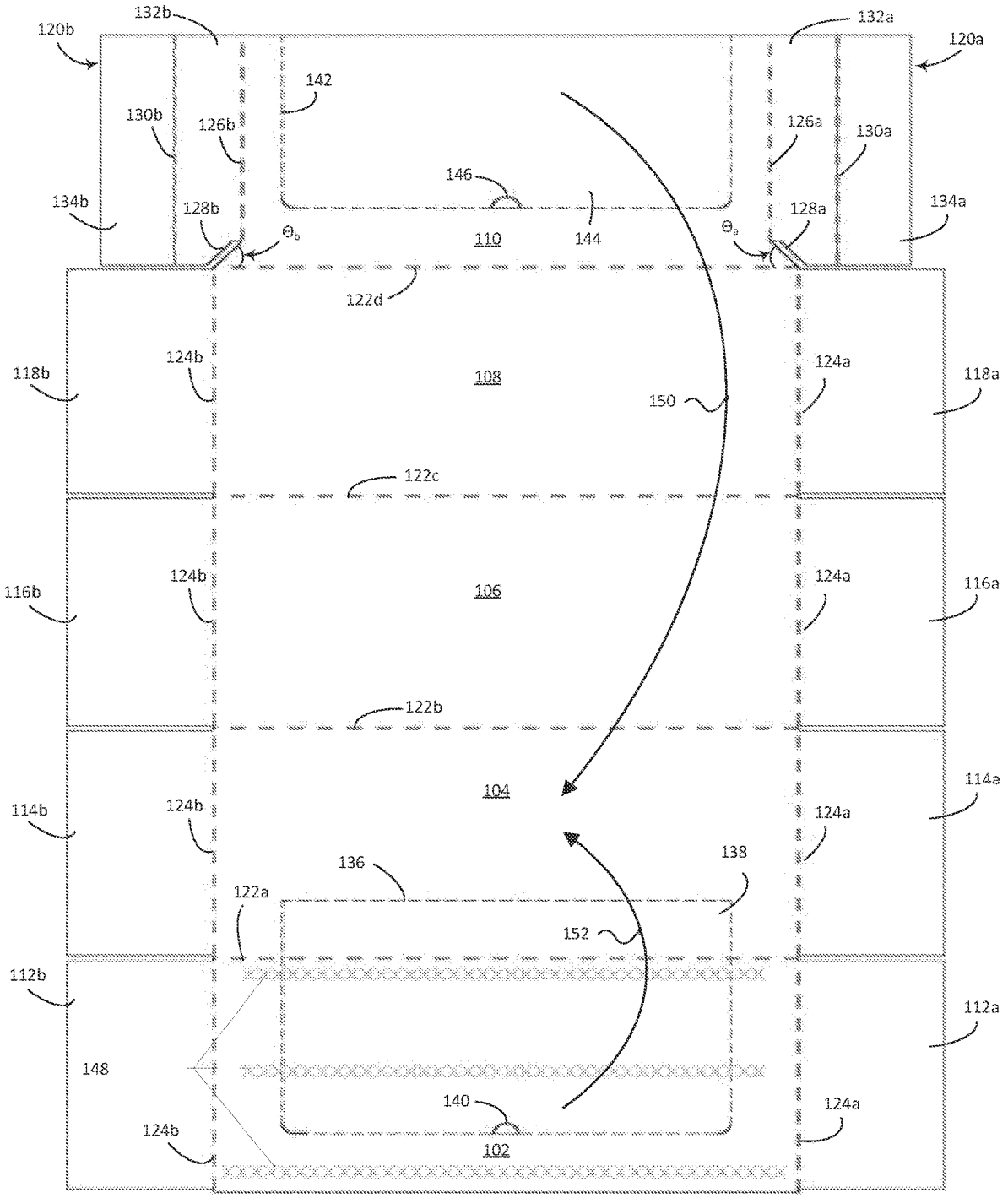
FIG. 1 is a plan view of a blank suitable for forming a container in accordance with this disclosure.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

Referring now to FIGS. 1-3, by way of examples, the present disclosure is generally directed to containers for shipping and display of product. More specifically, the present disclosure is directed to a blank comprising a one sheet of material that can be converted into a one-piece product container, or package, that holds bagged items, such as candy.

The container can be machine glued as part of the assembly from the flat blank. The assembled container needs sufficient strength and durability to survive shipping environments and be equipped with a removable portion to display the bagged items enclosed therein. Thus, the container disclosed herein should be produced at the lowest cost possible and have a removable portion for displaying and accessing the contents (e.g., bagged items) of the container.

Blank

Referring to FIG. 1, an example of a blank 100 suitable for forming a display container according to this disclosure is schematically illustrated. The blank 100 comprises a plurality of panels and a plurality of flaps that are integrally formed from one sheet of material. The blank 100 can be a die-cut out. In one or more examples, the blank 100 can comprise a front panel 102, a top panel 104, a back panel 106, a bottom panel 108, and a support panel 110. The front panel 102 and the support panel 110 can be disposed at opposite ends of the blank 100. The top panel 104 can be disposed adjacent the front panel 102 and the back panel 106 with the top panel 104 positioned between the front panel 102 and the back panel 106. The bottom panel 108 can be disposed adjacent the back panel 106 and the support panel 110 with the bottom panel 108 positioned between the back panel 106 and the support panel 110. In these examples, adjacent panels 102, 104, 106, 108, and 110 are connected with one another at fold lines 122 (e.g., predefined creases). In one or more examples, the fold lines 122 can be substantially parallel. The support panel 110 is configured to be attached to the front panel 102 as described in further detail below.

In one or more examples, the blank 100 can further comprise a first front panel flap 112*a*, a first top panel flap 114*a*, a first back panel flap 116*a*, and a first bottom panel flap 118*a* hingedly connected to the front panel 102, the top panel 104, the back panel 106, and the bottom panel 108, respectively, at fold lines 124*a*. The blank 100 also comprises a second front panel flap 112*b*, a second top panel flap 114*b*, a second back panel flap 116*b*, and a second bottom panel flap 118*b* hingedly connected to the front panel 102, the top panel 104, the back panel 106, and the bottom panel 108, respectively, at fold lines 124*b*. In these examples, the flaps 112*a*, 114*a*, 116*a*, and 118*a* are configured to cooperate with each other to enclose an end of the container formed from the blank 100. Similarly, the flaps 112*b*, 114*b*, 116*b*, and 118*b* are configured to cooperate with each other to enclose another end of the container formed from the blank 100. In one or more examples, the fold lines 124*a* and 124*b* are parallel or substantially parallel.

In one or more examples, the blank 100 further comprises a first support panel flap 120*a* hingedly connected to the support panel 110 at fold line 126*a* and a second support panel flap 120*b* hingedly connected to the support panel 110 at fold line 126*b*. The first support panel flap 120*a* can include a flap fold line 130*a* or perforated channel that promotes folding of the first support panel flap 120*a* along the flap fold line 130*a*. In some non-limiting examples, the flap fold line 130*a* may divide the first support panel flap 120*a* into a first portion 132*a* and a second portion 134*a*. The first portion 132*a* can be positioned between the second portion 134*a* and the support panel 110 with the first portion 132*a* directly, hingedly attached to the support panel 110. The second support panel flap 120*b* can include a flap fold line 130*b* or perforated channel that promotes folding of the second support panel flap 120*b* along the flap fold line 130*b*. In some non-limiting examples, the flap fold line 130*b* may divide the second support panel flap 120*b* into a first portion 132*b* and a second portion 134*b*. The first portion 132*b* can be positioned between the second portion 134*b* and the support panel 110 with the first portion 132*b* directly, hingedly attached to the support panel 110.

In one or more examples, the fold line 126*a* can extend parallel or substantially parallel to the fold line 124*a* and may be offset from the fold line 124*a* by a predefined distance. The first support panel flap 120*a* can include an angled cut 128*a* that is formed at an angle $\Theta_a$ and extends between the offset fold lines 124*a* and 126*a*. In some non-limiting examples, the angle $\Theta_a$ is approximately 45°. Similarly, the fold line 126*b* can extend parallel or substantially parallel to the fold line 124*b* but offset from the fold line 124*b* by a predefined distance. The second support panel flap 120*b* can include an angled cut 128*b* that is formed at an angle Θb and extends between the offset fold lines 124*b* and 126*b*. In some non-limiting examples, the angle Θb is approximately 45°. In one or more examples, the angle Θb is substantially the same size as the angle $\Theta_a$.

The blank 100 can have various dimensions. In one or more examples, the blank 100 comprises a front panel 102 and back panel 106 that are substantially the same size and a top panel 104 and bottom panel 108 that are substantially the same size so that the container formed from the blank 100 has the shape of a rectangular prism to promote the stacking of containers. In one example, the blank 100 is 59½ in (L)×35¾ in (W) and comprises a front panel 102 having a length of approximately 12 in, a top panel 104 having a length of approximately 11⅞ in, a back panel 106 having a length of approximately 11 15/16 in, a bottom panel 108 having a length of approximately 11¾ in and a support panel 110 having a length of approximately 11 15/16 in. It is contemplated that the blank 100 can be designed to have other dimensions and/or relative size proportions. Additionally, it is contemplated that the relative dimensions of the various panels 102, 104, 106, 108, 110 and/or flaps 112, 114, 116, 118, 120 can take into account any spacing requirements for providing separation or gaps between the flaps 112, 114, 116, 118, 120, and/or the thickness of the support panel 110 that is attached to the front panel 102.

The blank 100 can also be made out of various materials including recycled materials. As an example, the blank 100 may be fabricated from a wide variety of suitable materials including, but not limited to, paper, cardboard (corrugated and otherwise), wood, metal, and plastic. For reasons of strength and economy, materials for containers according to the present disclosure typically include corrugated cardboard.

The blank 100 includes a first line of weakness 136 that defines a first severable portion 138 formed in the front panel 102 and top panel 104. The first severable portion 138 is configured to be separable and removable from the remainder of the blank 100, in particular from the front panel 102 and top panel 104, via the first line of weakness 136. It is contemplated that the first severable portion 138 is not limited to the particular shape and configuration illustrated in FIG. 1 and can be formed in other shapes, sizes, and/or locations on the front panel 102 and top panel 104.

In one or more examples, the first severable portion 138 of the front panel 102 and top panel 104 is generally rectangular in shape and includes an aperture 140 adjacent to the midpoint of a lower part of the first line of weakness 136. In one example configuration, as depicted in FIG. 1, the aperture 140 is semi-circular in shape with its lower edge adjacent the front panel 102 and its midpoint extending upwardly into the severable portion 136 such that its upper edge is arcuate in shape. In these examples, the aperture 140 provides a means of grasping the edge of the first severable portion 138 and initiating the tearing or severing operation along the first line of weakness 136.

The blank 100 further includes a second line of weakness 142 that defines a second severable portion 144 formed in the support panel 110. The second severable portion 144 is configured to be separable and removable from the remainder of the blank 100, in particular from the support panel 110, via the second line of weakness 142. The second severable portion 144 is configured with dimensions that generally align with the first severable portion 138 for reasons that will be described in further detail below. In some non-limiting examples, the second severable portion 144 is rectangular with a width that generally corresponds to the width of the first severable portion 138. It is contemplated that the second severable portion 144 is not limited to the particular shape and configuration illustrated in FIG. 1 and can be formed in other shapes, sizes, and/or locations on the support panel 110 provided the second severable portion 144 generally aligns with the first severable portion 138.

In one or more examples, the second severable portion 144 of the support panel 110 is generally rectangular in shape and includes an aperture 146 adjacent to the midpoint of a lower part of the second line of weakness 142. In one example configuration, as depicted in FIG. 1, the aperture 146 is semi-circular in shape with its lower edge adjacent the support panel 110 and its midpoint extending upwardly into the second severable portion 144 such that its upper edge is arcuate in shape. In these examples, the aperture 146 provides a means of grasping the edge of the second severable portion 144 and initiating the tearing or severing operation along the second line of weakness 142.

The weakening of the region of the front and top panels 102 and 104, which comprises the first line of weakness 136, and the weakening of the region of the support panel 110, which comprises the second line of weakness 142, may be accomplished by full or partial perforation of the relevant panel material, full or partial scoring thereof, partial severing, or any other suitable method known in the art. Whatever the method of forming the lines of weakness, the lines of weakness can exhibit sufficient strength to survive shipping and handling of the container without premature rupture while remaining sufficiently easy to rupture to facilitate opening and leave a reasonably well defined opening upon removal of the first and/or second severable portions 138 and 144.

Assembly

Referring now to FIGS. 2A-2I, there are schematic illustrations of the steps for forming a product container 200 from the blank 100 in FIG. 1. The product container 200 can be hand assembled and packed by a person or automated.

Figure 2A:
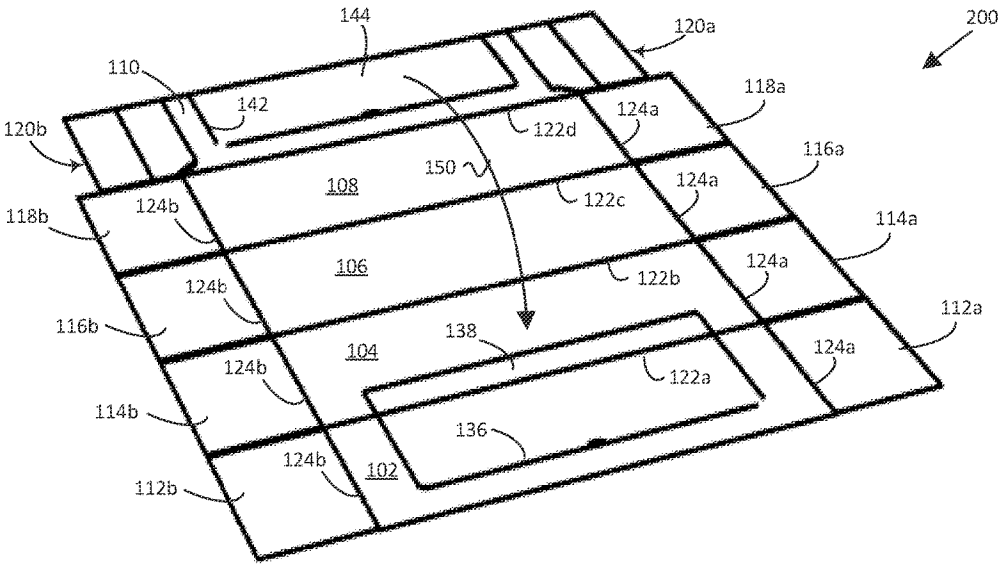
FIGS. 2A-2I are component diagrams illustrating one implementation of an example method for forming the container from the blank shown in FIG. 1.
Figure 2B:
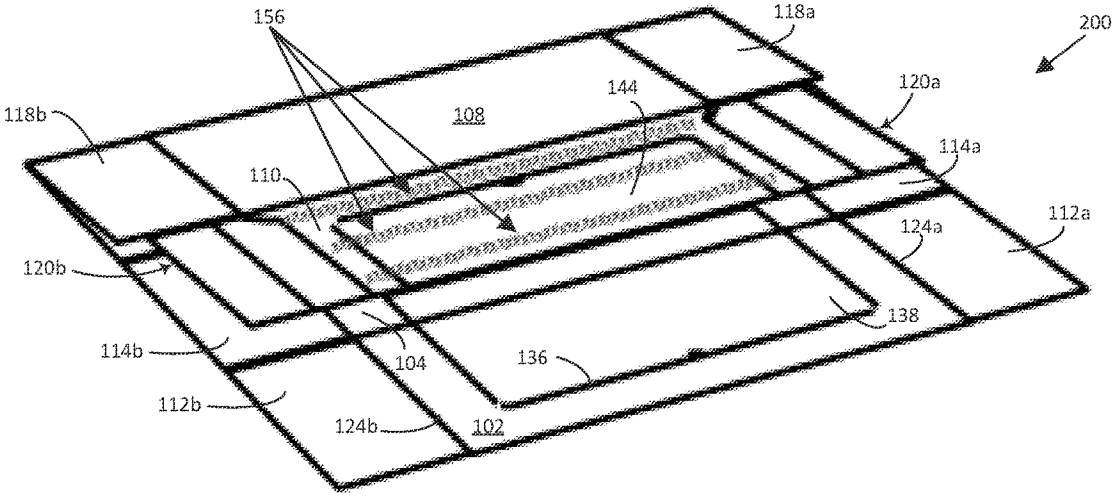
Figure 2C:
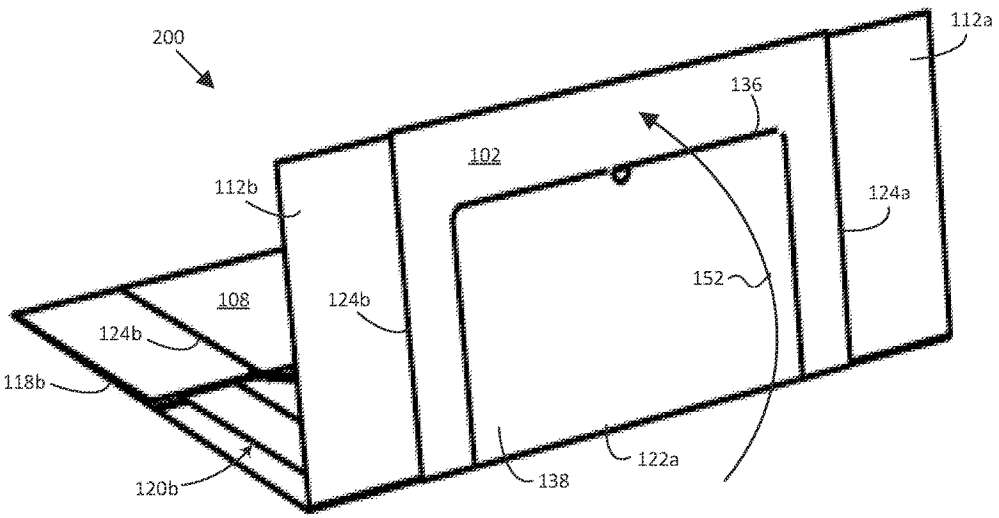

Referring to FIGS. 2A-2B, the blank 100 is assembled, or converted, into the product container 200 by folding the support panel 110 along fold line 122*c* in the direction 150 of the top panel 104 such that the support panel 110 is disposed over the top panel 104. The support panel 110 is folded so that an outer surface of the support panel 110, which can include an adhesive 156, such as glue, is exposed. In some non-limiting examples, the support panel 110 may include multiple strips of adhesive 156, as shown in FIG. 2B. It is contemplated that the surface of the support panel 110 may contain any suitable adhesive pattern and is not limited to any specific number of strips.

Figure 2D:
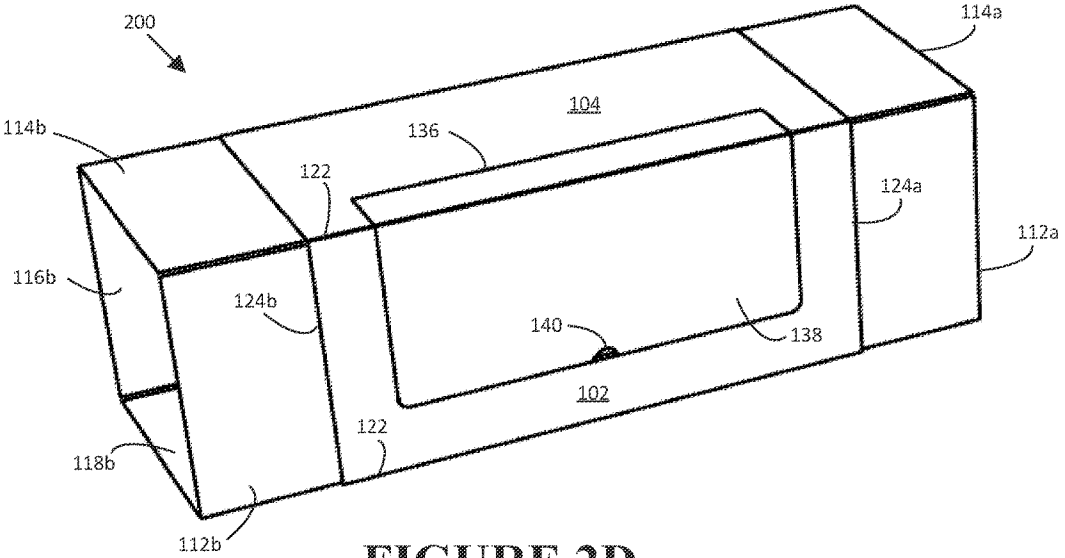

In one or more examples, the front panel 102 is then folded along fold line 122*a* in the direction 152 of the support panel 110 for attachment to the support panel 110. In this example, the strips of adhesive 156 are disposed on the support panel 110. But, in other examples, the strips of adhesive may be disposed on the front panel 102 (e.g., 148 in FIG. 1) or on both the front panel 102 and the support panel 110. The strips of adhesive 156 are then adhered, or otherwise affixed to an inner surface, or mating surface, of the front panel 102 thereby securing the front panel 102 to the support panel 110. In this manner, the front panel 102 overlaps with the support panel 110 and the support panel 110 reinforces the front panel 102 by providing a double layer of material. This provides increased thickness at the front panel 102 resulting in improved structural integrity and stacking strength of the container 200 while simultaneously making the container 200 more resistant to inadvertent perforations of the first and second lines of weakness 136, 142. At this stage, the panels 102, 104, 106, 108, and 110 form the general three-dimensional shape of the container 200, but the flaps 112-120 are still unsecured, as shown in FIGS. 2D-2E.

One particular advantage of this disclosure is that the process of folding panels and adhering panels together (e.g., adhering the front panel 102 to the support panel 110) described above can be performed by one standard machine. This process does not require any operations, such as applying glue, to be performed by a second specialty machine. Thus, the container 200 formed by the blank 100 of this disclosure can be assembled in a simple, cost-effective manner using a single standard machine (e.g., for gluing).

Figure 2F:
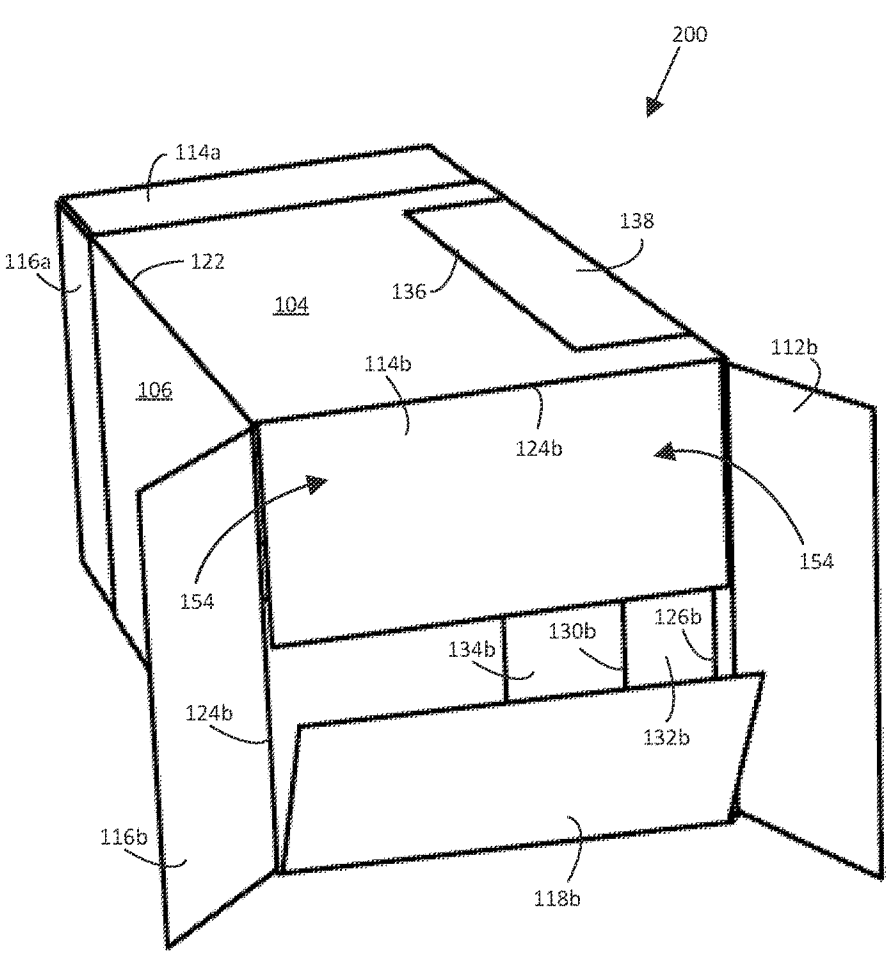
Figure 2E:
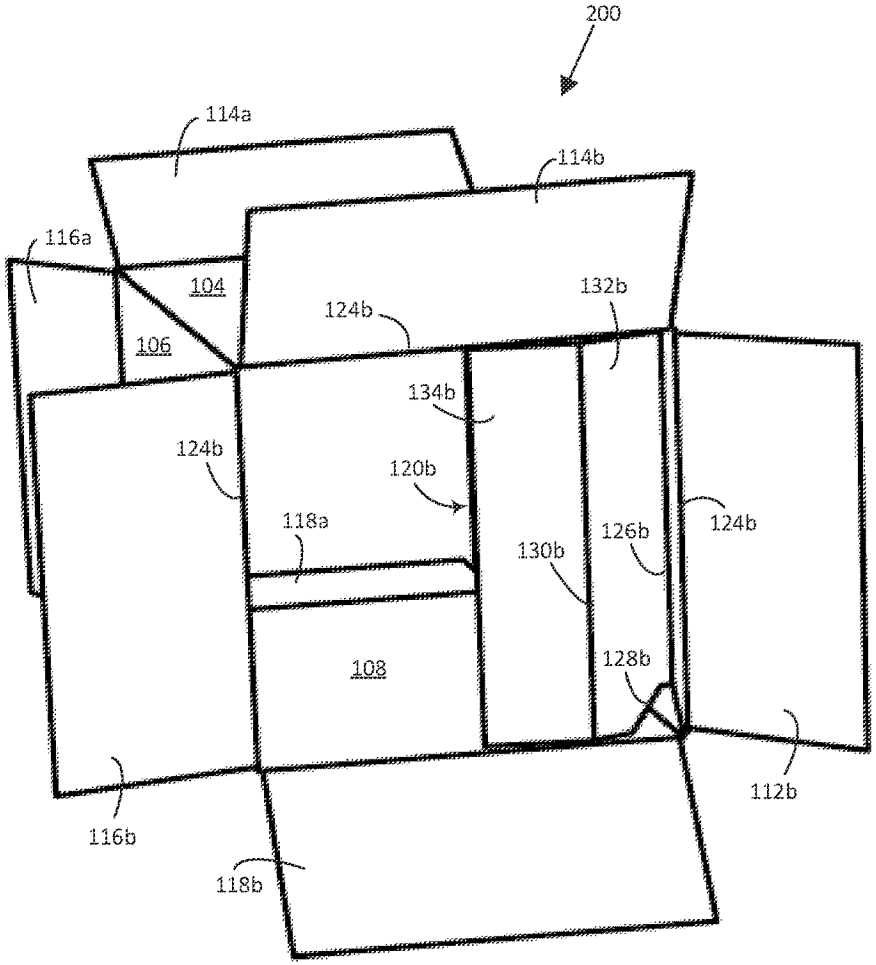

In one or more examples, the first and second support panel flaps 120*a* and 120*b* can be folded inwardly (i.e., into the interior of the container 200) along fold lines 126*a* and 126*b* respectively, as shown in FIG. 2E. Then, the remaining flaps 112*a*-118*a* can be folded inwardly along fold lines 124*a* orthogonal to the panels 102, 104, 106, and 108, respectively. Similarly, the flaps 112*b*-118*b* can be folded inwardly along fold lines 124*b* orthogonal to the panels 102,

104, 106, and 108, respectively. In one non-limiting example, the flaps 114*b* and 118*b* can be folded inwardly orthogonally to panels 104 and 108, respectively, and the flaps 112*b* and 116*b* are folded inwardly 154 orthogonally to overlie the flaps 114*b* and 118*b*, as shown in FIG. 2F. A length of tape 158 can be adhered to the seam where the flaps 112*b* and 116*b* meet, although it will be appreciated that other suitable means of securing the container 200 in its assembled condition may be used, such as staples, adhesives, etc. With one side assembly sealed, goods, such as individually packaged foods, can be loaded into the opposing end of the container 200 before sealing the side in a similar manner with a length of tape 158 resulting in the formation of an enclosed container.

The first and second support panel flaps 120*a*, 120*b* advantageously provide improved structural integrity and stacking strength to the container 200 formed from the blank. Additionally, the first and second support panel flaps 120*a*, 120*b* provide reinforcement to the front panel 102 as will be described in further detail.

Figure 3B:
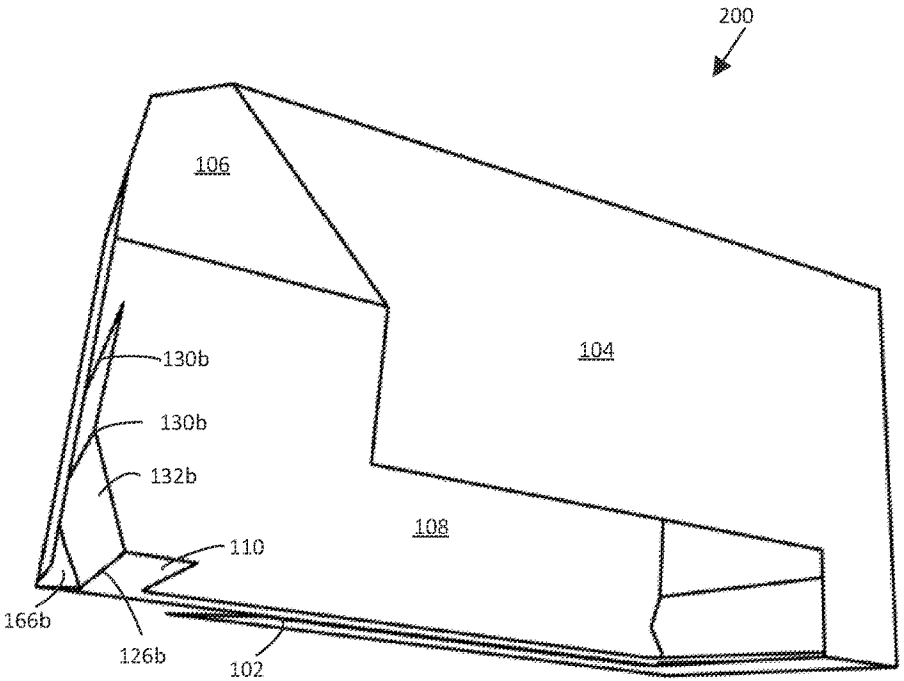
FIGS. 3A-3B are component diagrams depicting a partial cut-away view of the container shown in FIG. 2H in accordance with this disclosure.
Figure 3A:
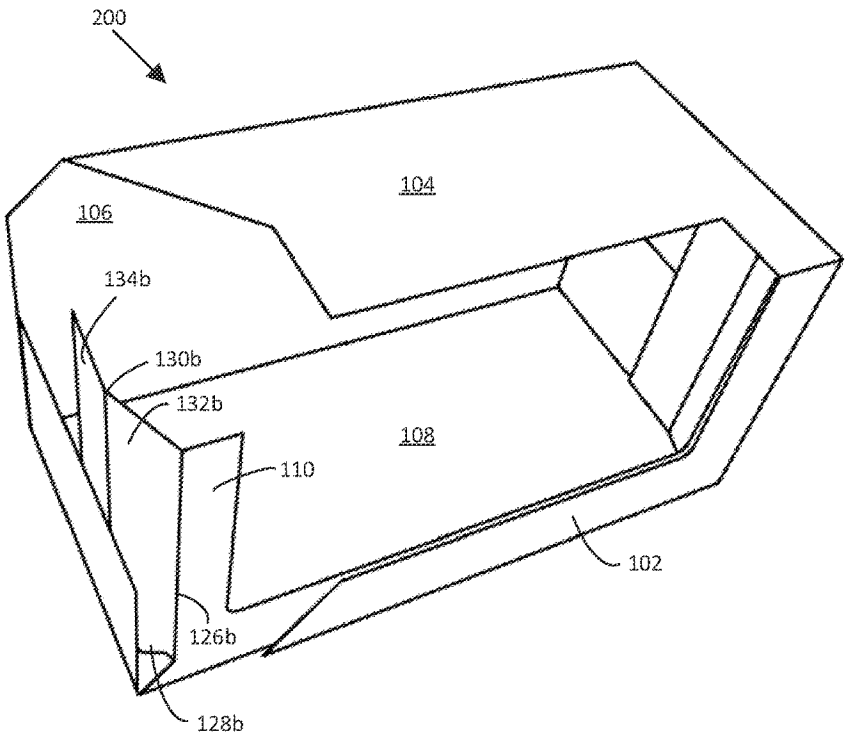

In one or more examples, the second support panel flap 120*b* is folded inwardly along fold line 126*b*. The first portion 132*b* of the second support panel flap 120*b* extends diagonally across an interior corner of the container 200 that is formed where the front panel 102 meets the orthogonally disposed flaps 112*b*, 114*b*, and 118*b*, as shown in FIGS. 3A-3B. In these examples, a space 166*b* is formed in the interior of the container 200 that is defined by the first portion 132*b* and the corner formed by the flaps 112*b*, 114*b*, 118*b* and the front panel 102, as shown in FIG. 3B. The space 166*b* can be in the shape of a triangle, but is not so limited. The second portion 134*b* of the second support panel flap 120*b* is folded along fold line 130*b* in order to place the second portion 134*b* flush against the surface of one or more flaps 112*b*, 114*b*, and 118*b*.

In these examples, the first portion 132*b* thereby forms a support structure in the interior corner of the container 200 defined by the first portion 132*b*, the front panel 102, and flaps 112*b*, 114*b*, 118*b*. Additionally, the angled cut 128*b* of the second support panel flap 120*b* can add significant packing strength to the container 200.

Similarly, in some non-limiting examples, the first support panel flap 120*a* is folded inwardly along fold line 126*a*. The first portion 132*a* of the first support panel flap 120*a* extends diagonally across an interior corner of the container 200 that is formed where the front panel 102 meets the orthogonally disposed flaps 112*a*, 114*a*, and 118*b* (not shown). In these examples, a space is formed in the interior of the container 200 that is defined by the first portion 132*a* and the corner formed by the flaps 112*a*, 114*a*, 118*a* and the front panel 102. The space can be in the shape of a triangle, but is not so limited. The second portion 134*a* of the first support panel flap 120*a* is folded along fold line 130*a* in order to place the second portion 134*a* flush against the surfaces of one or more flaps 112*a*, 114*b*, and 118*a*.

In these examples, the first portion 132*a* thereby forms a support structure in the interior corner of the container 200 defined by the first portion 132*a*, the front panel 102, and flaps 112*a*, 114*a*, 118*a*. Additionally, the angled cut 128*a* of the second support panel flap 120*b* can add significant packing strength to the container 200.

Figure 2H:
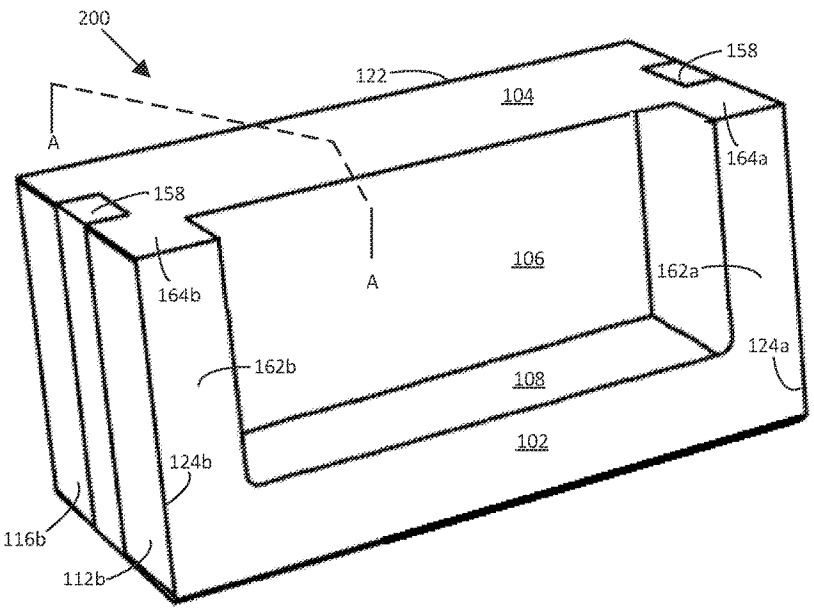
Figure 2G:
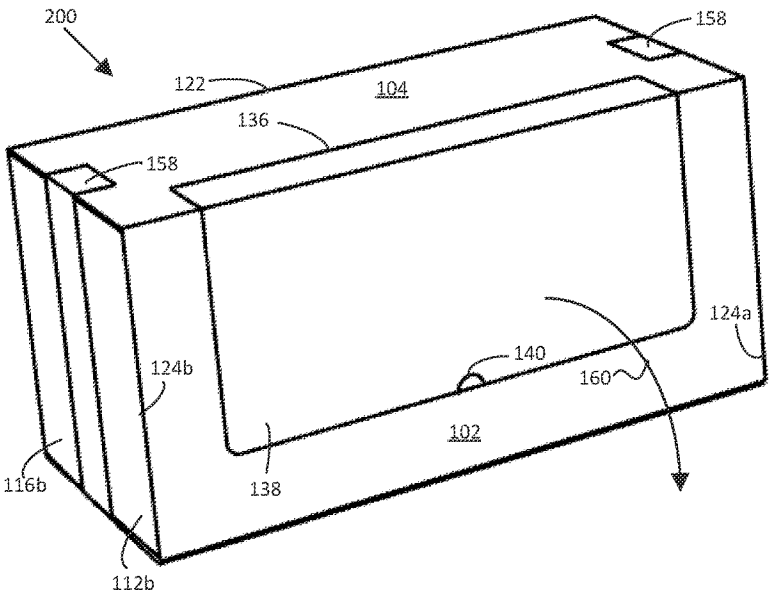
Figure 2I:
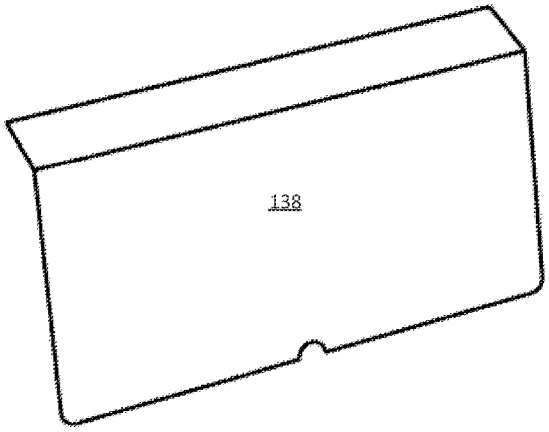

To open the container 200 for access to the products therein, the consumer or customer inserts one or more fingers or a tool into the apertures 140 and 146 that are aligned as a result of the attachment of the support panel 110 to the front panel 102. The one or more fingers or tool are then hooked around the edges defining the apertures 140, 146, the edges comprising part of the first and second severable portions 138, 144. The consumer or customer may then pull outwardly and upwardly, as shown by direction arrow 160 in FIG. 2G, so as to tear the first and second severable portions 138 and 144, which are attached to one another, free along the respective first and second lines of weakness 136, 142. The first and second lines of weakness 136, 142, which form preferential tearing zones, may be defined by full or partial perforation of the front panel material and support panel material, full or partial scoring thereof, partial severing, or any other suitable method known in the art. FIG. 2H depicts the container 200 after this tearing open sequence has concluded in which the first and second several portions are entirely free (i.e., removed) from the container, as shown in FIG. 2I. Removing the first and second severable portions 138 and 144 that are adhered/fixed to one another, removes portions of the front panel 102, top panel 104, and support panel 110. In some non-limiting examples, a pair of top panel segments 164*a*, 164*b* may be formed which each provide a ledge upon which other containers can be supported. After removal, the first and second severable portions 138, 144 can be disposed.

Tearing away the first and second severable portions 138, 144 provides a consumer or customer with access to product housed within the container 200. The support panel 110 attached to the front panel 102 strengthens the container 200, but does not deter the ease with which the first and second severable portions 138, 144 can be torn away to expose the product for shoppers. Because the first and second severable portions 138, 144 are completely removed, products may be extracted from the resulting opening even though other containers or articles may be stacked both above and below the subject container 200. Note that, as best depicted in FIG. 2H, the tearing of the first severable portion 138 from the front panel 102 leaves behind a generally U-shaped front portion 102 having front panel segments 162*a*, 162*b*, which define sides of the opening. The first and second support panel flaps 120*a* and 120*b*, respectively, reinforce these front panel segments 162*a* and 162*b*. In particular, the first portions 132*a*, 132*b* of the first and second support panel flaps 120*a*, 120 are each arranged at an angle resulting from the first portions 132*a*, 132*b* each extending diagonally between a respective interior corner of the container 200 that is formed where the front panel 102 meets the front panel flaps 112*a*, 112*b*.

The container 200 can be placed on a shelf as a single display as well as stacked in a pallet configuration such as, for example, a stack four layers high. The container 200 can be configured to carry a product weight of approximately 25 lbs.

One advantage of this disclosure concerning a blank 100 comprising a plurality of panels and a plurality of flaps that are integrally formed from one sheet of material, is that a standard piece of machinery can apply the adhesive 156 (e.g., glue) to a single surface on the support panel 110 to assemble the container 200 from the blank 100. Thus, the present disclosure eliminates any need to use multiple machines to apply adhesive and eliminates the need to perform multiple operations to attach separate components together to form the container because the container is formed from a single blank. Additionally, because of the increased stacking strength that is achieved by the features of the container 200 (e.g., a support panel 110 attached to and reinforcing the front panel 102 with support panel flaps 120*a*, 120*b* that strengthen the interior corners of the container 200 at the front panel 102), lighter materials can be used, which in turn results in reduced material usage and lower cost of manufacture. Accordingly, it is believed the present disclosure provides reduces the production costs, material, and assembly time, especially given that multi-component solutions often require a specialized machine to apply adhesive.

The implementations have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed is:

1. A container comprising:

a plurality of panels and a plurality of flaps integrally formed in a blank, the plurality of panels including a front panel, a top panel adjacent the front panel, a back panel adjacent the top panel, a bottom panel adjacent the back panel, and a support panel adjacent the back panel, wherein adjacent panels are connected with one another, and the plurality of flaps being configured to cooperate with each other to enclose the container at ends of the container;

a first line of weakness formed in the front panel and top panel, wherein the first line of weakness defines a first severable portion of the container that is configured to be removable; and a second line of weakness formed only in the support panel, wherein the second line of weakness defines a second severable portion of the container that is configured to be removable, the support panel being fixedly attached to an inner surface of the front panel such that the first severable portion and the second severable portion are generally aligned.

2. The container of claim 1, wherein the plurality of flaps comprises a first support panel flap and a second support panel flap each hingedly connected to the support panel.

3. The container of claim 2, wherein the first and second support panel flaps each include an angled cut formed at an angle $\Theta_a$, $\Theta_b$ of approximately 45°.

4. The container of claim 2, wherein each support panel flap comprises a first portion and a second portion, the first portion being positioned between the second portion and the support panel such that each first portion is directly attached to the support panel.

5. The container of claim 4, wherein the first portion extends diagonally across an interior corner of the container formed where the front panel meets one or more of the plurality of flaps.

6. The container of claim 5, wherein the second portion of each support panel flap is disposed flush against surfaces of the plurality of flaps at each of the respective ends of the container.

7. The container of claim 1, further comprising a first length of tape applied to a seam where flaps meet at one end of the container and a second length of tape applied to a seam where flaps meet at an opposing end of the container.

8. The container of claim 1, wherein the support panel is fixedly attached to the interior surface of the front panel using adhesive.

9. A container comprising:

a plurality of panels comprising a front panel, a top panel adjacent the front panel, a back panel adjacent the top panel, a bottom panel adjacent the back panel, and a support panel adjacent the back panel, wherein adjacent panels are connected with one another;

a plurality of flaps configured to cooperate with each other to enclose the container at ends of the container, the plurality of flaps comprising at least a first support panel flap and a second support panel flap each hingedly connected to the support panel, wherein the first and second support panel flaps each include an angled cut;

wherein the plurality of panels and the plurality of flaps are integrally formed in a blank;

a first line of weakness formed in the front panel and top panel, wherein the first line of weakness defines a first severable portion of the container that is configured to be removable; and a second line of weakness formed only in the support panel, wherein the second line of weakness defines a second severable portion of the container that is configured to be removable, wherein the support panel is fixedly attached to an inner surface of the front panel.

10. The container of claim 9, wherein the angled cut is formed at an angle $\Theta_a$, $\Theta_b$ of approximately 45°.

11. The container of claim 9, wherein each support panel flap comprises a first portion and a second portion, the first portion being positioned between the second portion and the support panel such that each first portion is directly attached to the support panel.

12. The container of claim 11, wherein the first portion extends diagonally across an interior corner of the container formed where the front panel meets one or more of the plurality of flaps.

13. The container of claim 12, wherein the second portion of each support panel flap is disposed flush against surfaces of the plurality of flaps at each of the respective ends of the container.

14. The container of claim 9, wherein the first severable portion and the second severable portion are generally aligned.

15. The container of claim 9, wherein the support panel is fixedly attached to the interior surface of the front panel using adhesive.

16. The container of claim 9, further comprising a first length of tape applied to a seam where flaps meet at one end of the container and a second length of tape applied to a seam where flaps meet at an opposing end of the container.

17. A container comprising:

a plurality of panels and a plurality of flaps integrally formed in a blank;

wherein the plurality of panels comprises a front panel, a top panel adjacent the front panel, a back panel adjacent the top panel, a bottom panel adjacent the back panel, and a support panel adjacent the back panel, wherein adjacent panels are connected with one another, and wherein the plurality of flaps are configured to cooperate with each other to enclose the container at ends of the container, the plurality of flaps comprising at least a first support panel flap and a second support panel flap each hingedly connected to the support panel, wherein the first and second support panel flaps each include an angled cut, a first line of weakness formed in at least the front panel, wherein the first line of weakness defines a first severable portion of the container that is configured to be removable; and a second line of weakness formed only in the support panel, wherein the second line of weakness defines a second severable portion of the container that is configured to be removable, the support panel being fixedly attached to an inner surface of the front panel such that the first severable portion and the second severable portion are generally aligned.

18. The container of claim 17, wherein the angled cut is formed at an angle $\Theta_a$, $\Theta_b$ of approximately 45°.

19. The container of claim 17, wherein each support panel flap comprises a first portion and a second portion, the first portion being positioned between the second portion and the support panel such that each first portion is directly attached to the support panel.

20. The container of claim 19, wherein the first portion extends diagonally across an interior corner of the container formed where the front panel meets one or more of the plurality of flaps.

* * * * *